US007448688B2

(12) United States Patent
Farah

(10) Patent No.: US 7,448,688 B2
(45) Date of Patent: Nov. 11, 2008

(54) FOOTREST

(76) Inventor: Daniel Farah, 1571 Anita, Grosse Pointe Woods, MI (US) 48236

( * ) Notice: Subject to any disclaimer, the term of this patent is extended or adjusted under 35 U.S.C. 154(b) by 0 days.

(21) Appl. No.: 11/738,060

(22) Filed: Apr. 20, 2007

(65) Prior Publication Data

US 2007/0246991 A1 Oct. 25, 2007

Related U.S. Application Data

(60) Provisional application No. 60/793,364, filed on Apr. 20, 2006.

(51) Int. Cl.
*A47C 7/52* (2006.01)

(52) U.S. Cl. ..... 297/423.39; 297/217.7; 297/188.06; 108/47

(58) Field of Classification Search ..... 297/254, 297/255, 423.15, 423.18, 423.39, 207.7, 297/188.06, 399, 400, 217.7; 108/44, 46, 108/47; 248/118.5, 235
See application file for complete search history.

(56) References Cited

U.S. PATENT DOCUMENTS

| | | | | | |
|---|---|---|---|---|---|
| 1,299,827 | A * | 4/1919 | Edwards | 297/255 |
| 3,009,613 | A * | 11/1961 | Noland | 224/265 |
| 3,335,679 | A * | 8/1967 | Bown | 108/44 |
| 3,865,431 | A * | 2/1975 | Zakhi | 297/217.1 |
| 4,947,961 | A * | 8/1990 | Dudley | 182/92 |
| 4,949,924 | A * | 8/1990 | Carmody | 248/215 |
| 5,222,641 | A * | 6/1993 | Medeiros, Jr. | 297/244 |
| 5,370,060 | A * | 12/1994 | Wang | 108/44 |
| 6,224,029 | B1 * | 5/2001 | Marble et al. | 248/214 |

* cited by examiner

*Primary Examiner*—Peter R. Brown
(74) *Attorney, Agent, or Firm*—Rader, Fishman & Grauer, PLLC

(57) ABSTRACT

Disclosed is a footrest for a handrail. The footrest includes an attachment portion configured to receive the handrail. The footrest further includes a vertical offset portion and a foot receiving portion.

11 Claims, 5 Drawing Sheets

FOOTREST

CROSS REFERENCE TO RELATED APPLICATIONS

This application claims priority to U.S. Provisional Application Ser. No. 60/793,364, entitled "Footrest for Handrails", filed Apr. 20, 2006, the entire contents of which are incorporated by reference herein.

FIELD

The present embodiments relate to a footrest, and in particular, to a footrest for use with a handrail.

BACKGROUND INFORMATION

Individuals in hotels, apartments, or cruise ships often desire relaxation on the balcony during pleasurable weather conditions. Many times the confines of the balcony will not permit the use of traditional footrests or ottomans because space is at a premium. Prior methods of providing footrests include the use of additional furniture and/or use of a railing itself. However, where space is at a premium, ottomans or ottoman-like furniture is not convenient. Moreover, users may be tempted to place their feet directly on a railing or handrail which may over time damage the handrail paint or structural integrity, making the handrail loose or wobbly.

By offering users a simple footrest without utilizing precious floor space, users will be able to enjoy greater relaxation year round. The embodiments described hereinafter were developed in light of these and other drawbacks.

SUMMARY

Disclosed is a footrest for a handrail. The footrest includes an attachment portion configured to receive the handrail. The footrest further includes a vertical offset portion and a foot receiving portion.

In another embodiment, a footrest for a handrail is disclosed where the footrest is for use by a user. The footrest includes an attachment portion for holding the footrest on the handrail. The footrest also includes a foot receiving portion configured to receive at least one of the user's feet and a vertical offset portion connecting the foot receiving portion with the attachment portion.

In yet another embodiment, a footrest for a handrail includes a means for hanging the footrest upon the handrail and a means for receiving a foot.

DETAILED DESCRIPTION

A footrest is disclosed for use with a handrail. Although discussed herein for use with a handrail, the footrest may also be used with other stationary objects, such as fences, walls, etc. The footrest provides a user with a convenient place to rest their feet. Moreover, the footrest is easily transported and set-up to be affixed to a handrail that the user may be looking through while relaxing. In general, the footrest allows consumers to utilize confined areas for rest and relaxation where otherwise a footrest is not available, or a footrest would be too large for the space.

The footrest may be configured in a way that provides for a light weight and collapsible structure. Thus, a user may travel with the footrest and easily store the footrest during inclement weather, as well as selectively use the footrest at home. Some example applications include a residential balcony, where space may be limited. Other places of use include hotel or apartment balconies, boat and porch decks, and virtually any other location having a handrail.

One example of a footrest is configured to hang from or affix to the top of the handrail. It can be manufactured as a fixed and/or a removable device that is adjustable for both the handrail size (e.g., the width of the handrail), as well as the footrest height based on the handrail height. In an example, the footrest may be hooked or affixed over the top of a railing and will hang down about ten inches (10 in.) to about eighteen inches (18 in.) and an approximate width of about fourteen inches (14 in.). However, other dimensions may be used based on the railing dimensions, method of affixing to the handrail, or the desired width of the footrest.

Figure 1:
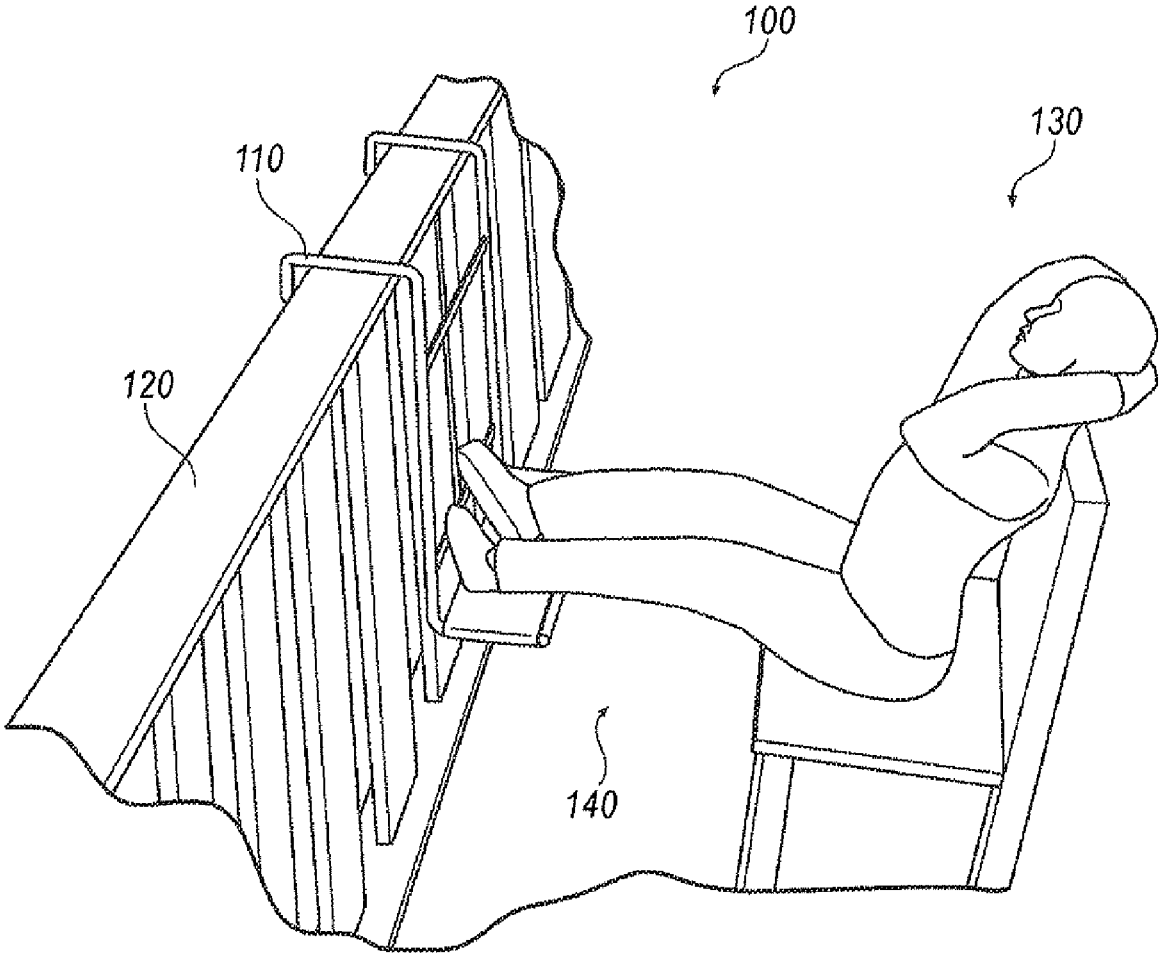
FIG. 1 is a perspective view of a footrest installed on a handrail.

FIG. 1 is a perspective view 100 of an embodiment of a footrest 110 installed on a handrail 120 for use by a user 130. Footrest 110 hangs on handrail 120 and is removable. Alternatively, footrest 110 may be permanently affixed to handrail 120. In areas having a confined space, such as a porch, balcony, or deck, footrest 110 allows for leisure seating while not occupying precious floor space 140 for movement. If, for example, an ottoman were used as a footrest, user 130 would have to be pushed away from handrail 120, possibly against a door or wall. Moreover, floor space would be occupied that would impede free movement of people around the porch. In general, footrest 110 may be made using weather resistant materials to avoid degradation from exposure to the elements. Examples of such materials include, but are not limited to, aluminum, PVC, vinyl, or resin. Additionally, footrest 110 may be configured for easy removal and storage.

Figure 2:
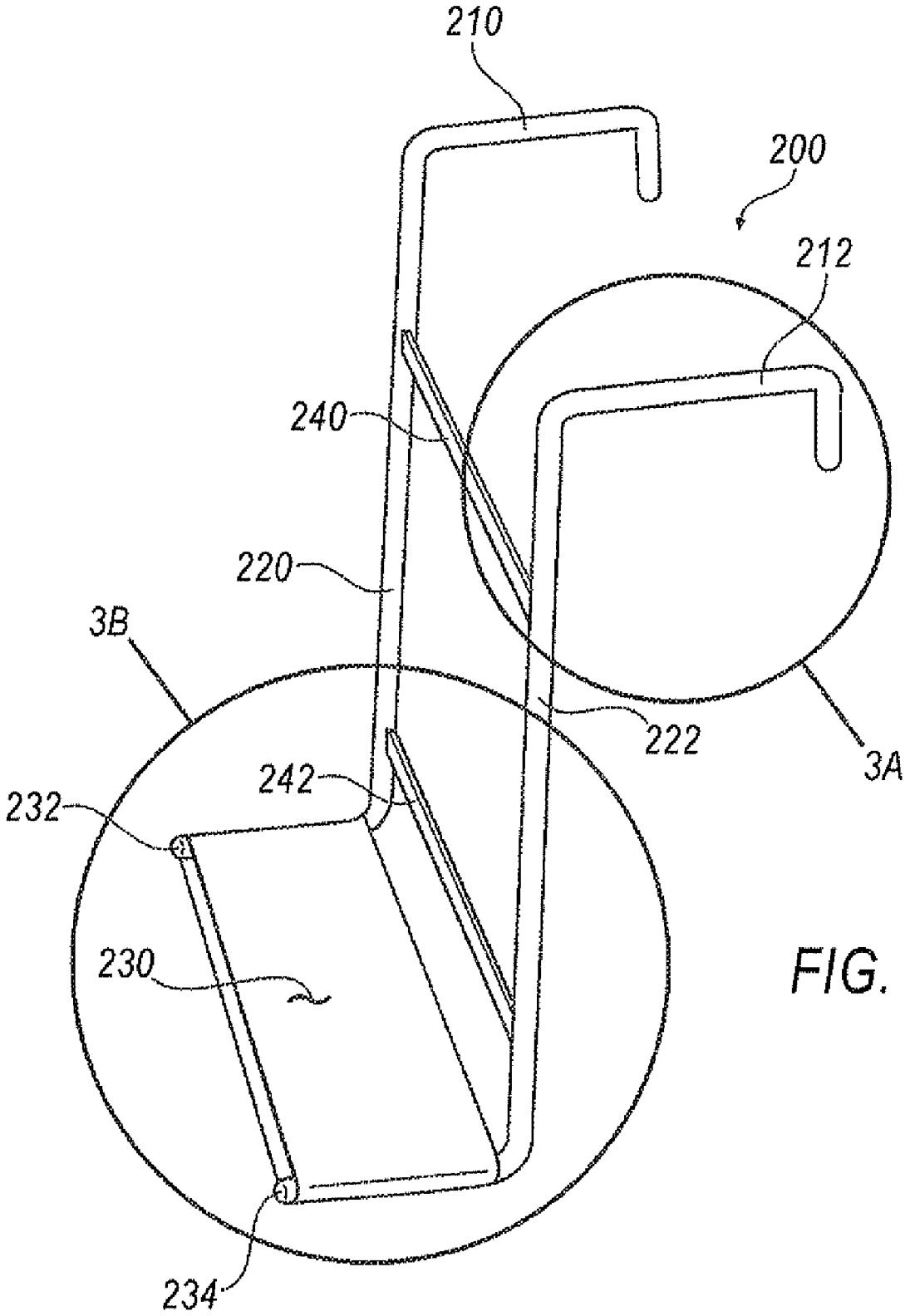
FIG. 2 is a side perspective view of a footrest.

FIG. 2 is a side perspective view of a footrest 200 including a pair of attachment portions 210, 212, a pair of vertical offset portions 220, 222, and a foot receiving portion 230. Attachment portions 210, 212 are configured to receive a handrail, such that footrest 200 may hang from the handrail and allow for a user to put their feet on foot receiving portion 230. They may be adjustable (as described below in detail with respect to FIG. 3A) to allow for the use of footrest 200 with many handrails. When traveling, the adjustability of attachment portions 210, 212 also allow a user to be confident that wherever footrest 200 is desired, the handrail may be used. In an embodiment, attachment portions 210, 212 are about six inches (6 in.) long.

Vertical offset portions 220, 222 connect attachment portion 210 and foot receiving portion 230. The length of vertical offset portions 220, 222 is selected for comfortable feet-up seating by a user. Vertical offset portions 220, 222 further include cross-members 240, 242 for adding stability and structure to footrest 200. As discussed below with respect to FIG. 3B, vertical offset portions 220, 222 may also be configured for adjustable length. Thus, a user may fine-tune the length so that foot receiving portion 230 is at the optimal location (e.g., height). In an embodiment, vertical offset portions 220, 222 are about eighteen inches (18 in.) long.

As shown, foot receiving portion 230 is made of a cloth or fabric surface which allows for a user to comfortably rest their feet. In an embodiment, foot receiving portion 230 is about twelve inches (12 in.) wide and is of a depth that allows a user to lay their feet across it horizontally (e.g., where the back or side of the leg, as well as the back of the heel are in contact with foot receiving portion 230). The large area of foot receiving portion 230 provides the user with a wide range of comfortable positions, as well as providing footrest space for multiple people.

The cloth or fabric may be weather resistant to provide for long life and aesthetic beauty. In other embodiments, foot receiving portion 230 may be offered with padding for additional user comfort. Foot receiving portion 230 includes loops at either end that are received by footrest extensions 232, 234 that extend away from vertical offset portions 220, 222, Footrest extensions 232, 234 may also include caps (e.g., plastic or rubber) that close any open end that may be present. However, other configurations of foot receiving portion 230 may use metal brackets or screws for attachment.

Figure 3A:
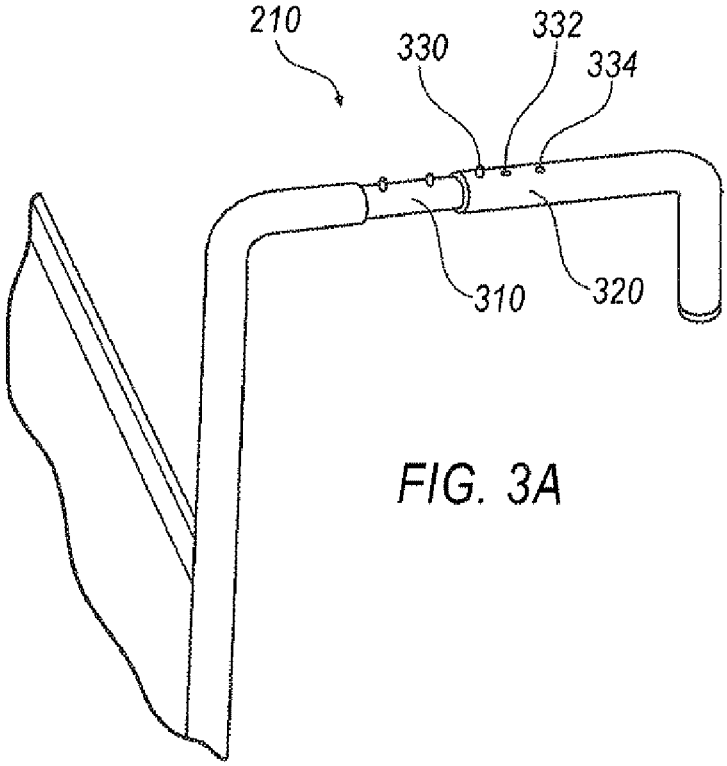
FIG. 3A is a perspective view of attachment portion.

FIG. 3A is a perspective view of attachment portion 210 showing an adjustability feature. The adjustment system includes an inner tube 310 that slides at least partially within an outer tube 320. A push pin 330 (e.g., a spring pin) may be pressed by a user to disengage holes 332, 334. When disengaged, inner tube 310 may be slid farther within outer tube 320 to reduce the length of attachment portion 210 to fit, for example, a narrow handrail. In the alternative, inner tube 310 may be pulled out of outer tube 320 to widen attachment portion 210 for wider handrails. Alternatively, rather than using push pin 330, a screw may be used to attach inner tube 310 with outer tube 320 at the desired length. However, a tool-less method allows a user to adjust attachment portion 210 while not having access to tools.

Figure 3B:
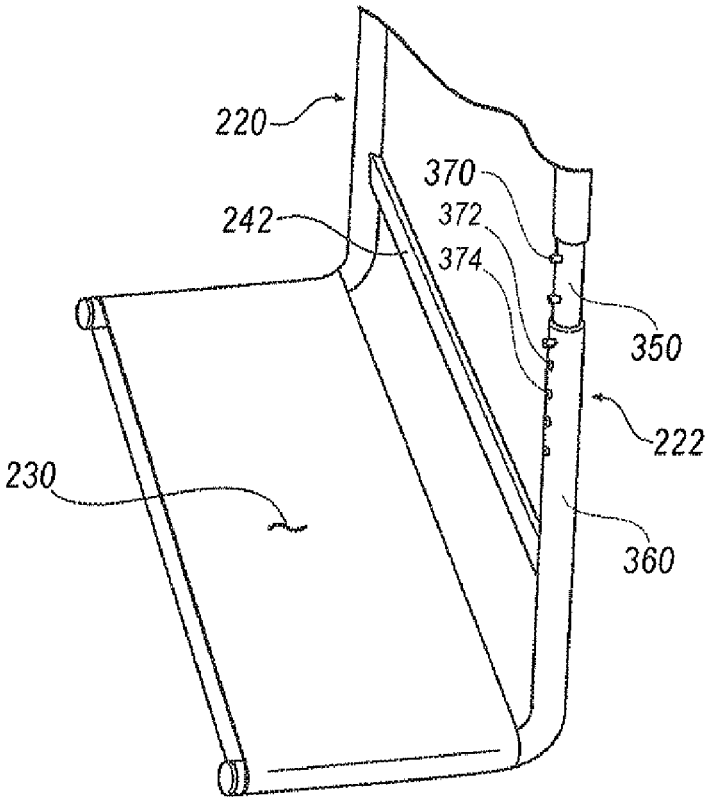
FIG. 3B is a partial perspective view of vertical offset portions.

FIG. 3B is a partial perspective view of vertical offset portions 220, 222 showing another adjustability feature. The adjustment system includes an inner tube 350 that slides at least partially within an outer tube 360. A push pin 370 (e.g., a spring pin) may be pressed by a user to disengage holes 372, 374. When disengaged, inner tube 350 may be slid farther within outer tube 360 to reduce the length of vertical offset portions 220, 222, effectively raising foot receiving portion 230. In the alternative, inner tube 350 may be pulled out of outer tube 360 to lengthen vertical offset portions 220, 222, effectively lowering foot receiving portion 230. Alternatively, rather than using push pin 370, a screw may be used to attach inner tube 350 with outer tube 360 at the desired length.

Figure 4A:
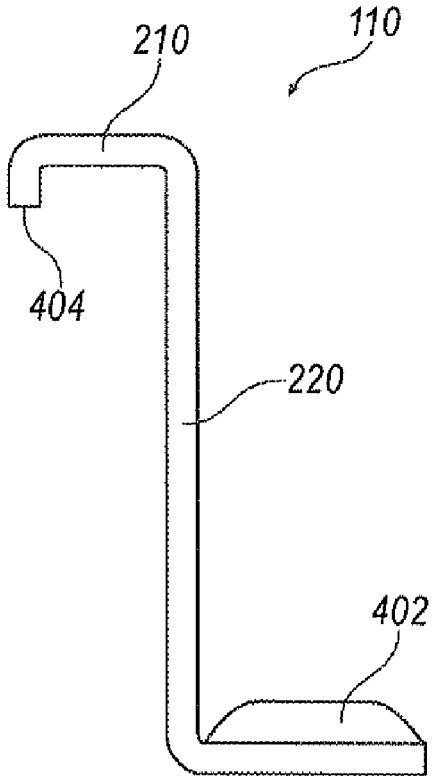
FIG. 4A is a side view of footrest.

FIG. 4A shows a side view of footrest 110, A padded foot receiving portion 402 is thicker than foot receiving portion 230 (see FIG. 2). Thus, a user may receive more or longer comfort in the padded material. Moreover, padded foot receiving portion 402 may include weather resistant padding material that may be sealed in a water-tight encasement to prevent water intrusion. Vertical offset portion 220 hangs straight down from attachment portion 210. Attachment portion 210 further includes a holding end 404 that protrudes downwardly from attachment portion 210 and grasps the handrail when installed. Holding end 404 prevents footrest 110 from sliding off of the handrail when pressure is applied by a user at padded foot receiving portion 402.

Figure 4B:
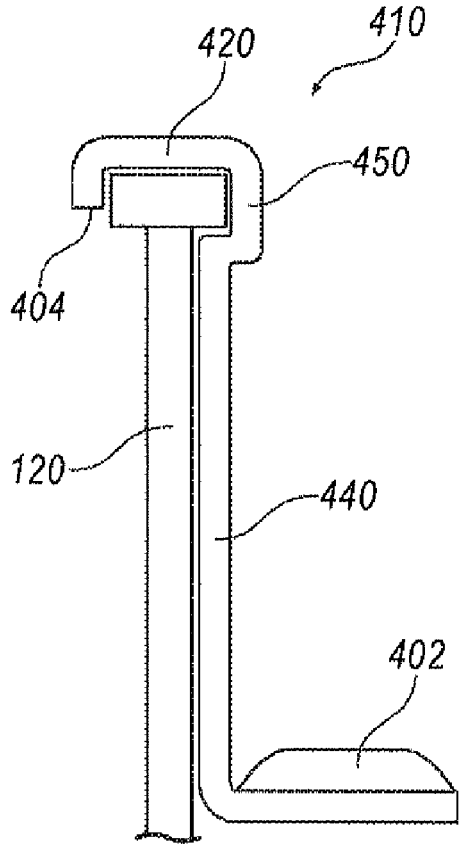
FIG. 4B is a side view of an alternative embodiment of a footrest.

FIG. 4B shows an alternative embodiment of a footrest 410. Here, a C-shaped attachment portion 420 is provided to further stabilize footrest 410 when installed on handrail 120. Vertical offset portion 440 is bumped inwardly from an upper vertical portion 450 providing a C-shape. A holding end 404 and upper vertical portion 450 lock footrest 410 in place at the top of handrail 120. Moreover, vertical offset portion 440 lies against handrail 120 which reduces or eliminates lateral motion that may be imparted when a user places their feet at padded foot receiving portion 402.

Figure 5:
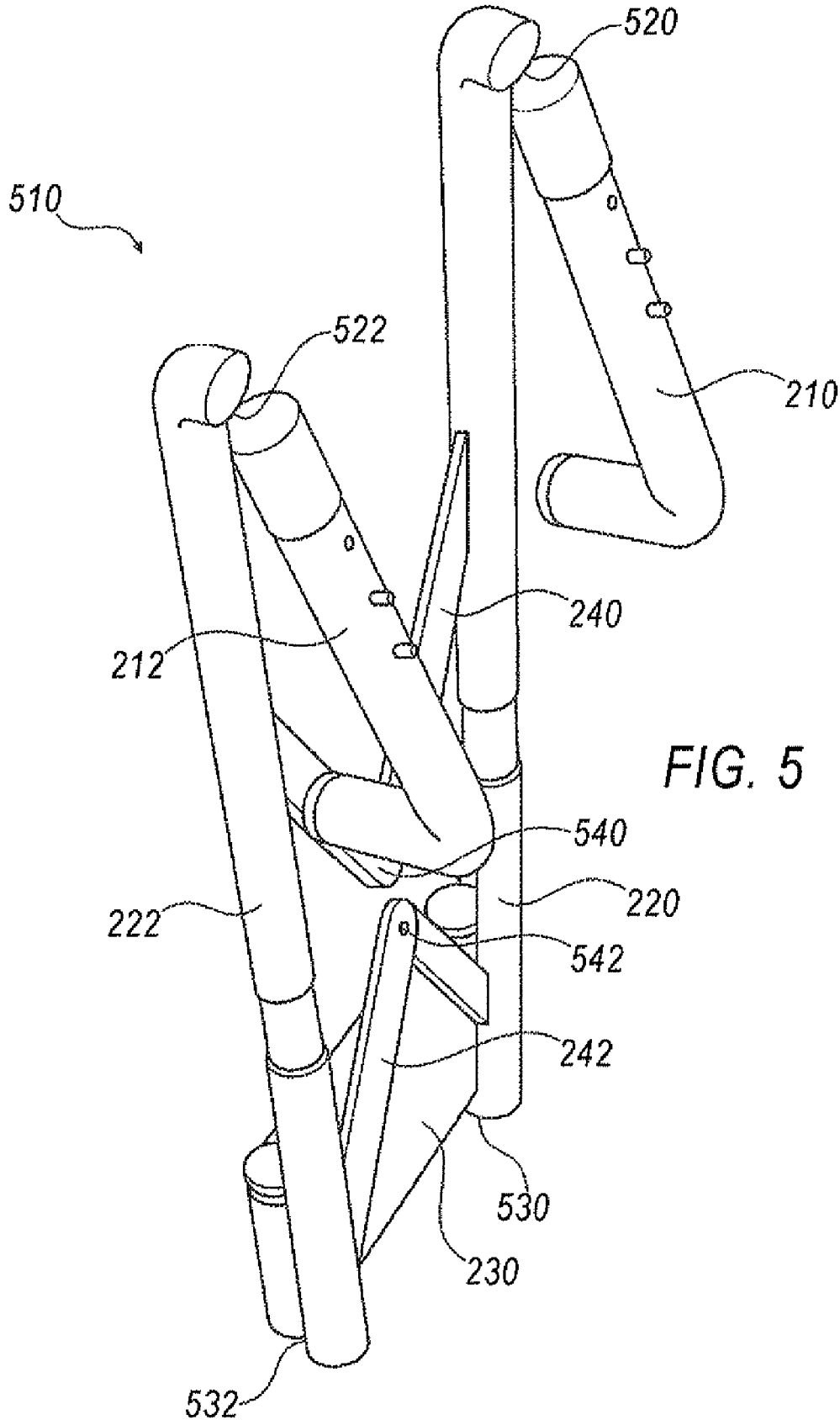
FIG. 5 is a perspective view of a collapsing footrest.

FIG. 5 is a perspective view of a collapsing footrest 510. Here, footrest 510 is entirely collapsible for ease of carrying and storage. Between the connection of each of attachment portions 210, 212 and vertical offset portions 220, 222 a set of hinges 520, 522 allow each of vertical offset portions 220, 222 to be folded toward vertical offset portions 220, 222 (as shown). Moreover, at the connection of vertical offset portions 220, 222 with foot receiving portion 230 a second pair of hinges 530, 532 allow the user to fold foot receiving portion 230 upwardly (as shown). In addition, cross-members 240, 242 include a pair of hinges 540, 542 near the center of cross-members 240, 242 that allow each cross member 240, 242 to be folded downward or upward. Thus, in aggregate collapsing footrest 510 reduces overall size in both depth and width for storage or carrying.

The present invention has been particularly shown and described with reference to the foregoing examples, which are merely illustrative of the best modes for carrying out the invention. It should be understood by those skilled in the art that various alternatives to the examples of the invention described herein may be employed in practicing the invention without departing from the spirit and scope of the invention as defined in the following claims. The examples should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

It is to be understood that the above description is intended to be illustrative and not restrictive. Many alternative approaches or applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

The present embodiments have been particularly shown and described, which are merely illustrative of the best modes. It should be understood by those skilled in the art that various alternatives to the embodiments described herein may be employed in practicing the claims without departing from the spirit and scope as defined in the following claims. It is intended that the following claims define the scope of the invention and that the method and apparatus within the scope of these claims and their equivalents be covered thereby. This description should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

The invention claimed is:

1. A footrest for a handrail comprising:

an attachment member for removably connecting the footrest to the handrail;

a foot receiving member comprising a flexible fabric for supporting a user foot, the flexible fabric suspended between a pair of elongated support members;

a vertical offset member connecting the foot receiving member to the attachment member, the vertical offset member comprising a first suspension member and a second suspension member disposed adjacent the first suspension member;

a first collapsible cross-member connecting the first suspension member to the second suspension member, the first collapsible cross-member comprising a first link and a second link pivotally connected to the first link, the first link having an end opposite its pivot connection to the second link pivotally connected to the first suspension member, and the second link having an end opposite its pivot connection to the first link pivotally connected to the second suspension member; and a second collapsible cross-member connecting the first suspension member to the second suspension member, the second collapsible cross-member member displaced away from the first collapsible cross-member and comprising a third link and a fourth link pivotally connected to the third link, the third link having an end opposite its pivot connection to the fourth link pivotally connected to the first suspension member, and the fourth link having an end opposite its pivot connection to the third link pivotally connected to the second suspension member, wherein the first link of the first collapsible cross-member and the third link of the second collapsible cross-member rotate in opposite directions about their respective pivot connections to the first suspension member when the cross-members are collapsed.

2. The footrest of claim 1, wherein the attachment member comprises a first portion movably connected to a second portion to enable selective positioning of a distal end of the second portion relative to the vertical offset member.

3. The footrest of claim 2, wherein the attachment member comprises an inner tube and an outer tube, the inner tube telescopically disposed within the outer tube.

4. The footrest of claim 1, wherein the vertical offset member comprises a first portion movably connected to a second portion to enable selective positioning of the attachment member relative to the foot receiving member.

5. The footrest of claim 4, wherein the vertical offset member comprises a first suspension member and a second suspension member disposed adjacent the first suspension member, the footrest further comprising:

a first collapsible cross-member connecting the first suspension member to the second suspension member; and a second collapsible cross-member connecting the first suspension member to the second suspension member, the ends of the first collapsible cross-member being connected to the first movable portion of the vertical offset member and the ends of the second collapsible cross-member being connected to the second movable portion of the vertical offset member.

6. The footrest of claim 1, wherein the attachment member and the foot receiving member are hingably connected to the vertical offset member to enable the footrest to be collapsed to a reduced size.

7. The footrest of claim 1, wherein the second end of the first link of the first collapsible cross-member and the second end of the first link of the second collapsible cross-member move toward one another when the cross-members are collapsed.

8. The footrest of claim 1, wherein the first cross-member is located proximate a first end of the first and second suspension members, and the second cross-member is located proximate a second end of the first and second suspension members, wherein the second end of the first link of the first cross-member is displaced toward the second end of the suspension members and the second end of the first link of the second cross-member is displaced toward the first end of the suspension members when the cross-members are collapsed.

9. The footrest of claim 1, wherein no portion of the cross-members extend beyond the ends of the vertical offset member when the cross-members are fully collapsed.

10. The footrest of claim 1, wherein the cross-members can be collapsed without removing the flexible fabric from the foot receiving member.

11. The footrest of claim 1, wherein the attachment member comprises a first portion movably connected to a second portion to enable selective positioning of a distal end of the second portion relative to the vertical offset member.

* * * * *